US010786887B2

(12) United States Patent
Isusi

(10) Patent No.: US 10,786,887 B2
(45) Date of Patent: Sep. 29, 2020

(54) HOLDING APPARATUS FOR HOLDING A PIPE IN A ROTATABLE MANNER TO BE MACHINED

(71) Applicant: Rothenberger AG, Kelkheim (DE)

(72) Inventor: Mikel Isusi, Abadiano (ES)

(73) Assignee: Rothenberger AG, Kelkheim (DE)

( * ) Notice: Subject to any disclaimer, the term of this patent is extended or adjusted under 35 U.S.C. 154(b) by 213 days.

(21) Appl. No.: 15/315,411

(22) PCT Filed: Jun. 26, 2015

(86) PCT No.: PCT/DE2015/100259
§ 371 (c)(1),
(2) Date: Dec. 1, 2016

(87) PCT Pub. No.: WO2016/000686
PCT Pub. Date: Jan. 7, 2016

(65) Prior Publication Data

US 2017/0197296 A1 Jul. 13, 2017

(30) Foreign Application Priority Data

Jun. 30, 2014 (DE) ..... 10 2014 109 150

(51) Int. Cl.
*B25B 5/14* (2006.01)
*B25B 1/20* (2006.01)
(Continued)

(52) U.S. Cl.
CPC ..... *B25B 5/147* (2013.01); *B25B 1/06* (2013.01); *B25B 1/12* (2013.01); *B25B 1/125* (2013.01); *B25B 1/20* (2013.01)

(58) Field of Classification Search
CPC .. B25B 1/06; B25B 1/12; B25B 1/125; B25B 1/20; B25B 1/22
(Continued)

(56) References Cited

U.S. PATENT DOCUMENTS 259,351 A * 6/1882 Ayer ..... B25B 1/205 269/90
3,819,163 A * 6/1974 Stunkard ..... B23D 21/04 266/56
(Continued)

FOREIGN PATENT DOCUMENTS

CN 101920499 A 12/2010
DE 2754964 A1 7/1978
(Continued)

OTHER PUBLICATIONS

International Search Report of PCT/DE2015/100259, dated Oct. 22, 2015.

*Primary Examiner* — Tyrone V Hall, Jr.
*Assistant Examiner* — Abbie E Quann
(74) *Attorney, Agent, or Firm* — Smartpat PLC

(57) ABSTRACT

A holding apparatus for holding a workpiece, which has a round and/or tubular cross section and is to be machined, in such a way that, in the held state, the workpiece can be rotated in relation to the holding apparatus, having at least two clamping arms, which are mounted in a pivotable manner on a base part and by means of which a clamping force can be exerted onto the workpiece, and having an adjustment mechanism for the clamping arms. Provision is made for the adjustment mechanism to have at least two drivers which are guided in a straight line, it being possible for the clamping arms to be pivoted or the clamping arms being pivoted toward one another by virtue of the movement of the drivers, wherein the drivers are arranged one behind the other as seen transversely in relation to the direction of movement of the drivers.

19 Claims, 7 Drawing Sheets

(51) Int. Cl.
*B25B 1/12* (2006.01)
*B25B 1/06* (2006.01)

(58) Field of Classification Search
USPC ..... 269/172
See application file for complete search history.

(56) References Cited

U.S. PATENT DOCUMENTS

| | | | | | |
|---|---|---|---|---|---|
| 4,355,793 | A | * | 10/1982 | Juneau | B23Q 3/06 269/155 |
| 4,362,261 | A | | 12/1982 | Cook, Jr. | |
| 4,463,635 | A | | 8/1984 | Hafla et al. | |
| 5,054,550 | A | * | 10/1991 | Hodge | E21B 19/168 166/78.1 |
| 5,740,702 | A | * | 4/1998 | Smith | B25B 13/5008 29/240 |
| 6,092,797 | A | | 7/2000 | You | |
| 6,672,185 | B1 | | 1/2004 | Behnke | |
| 2002/0074705 | A1 | * | 6/2002 | Marusiak | B25B 5/06 269/156 |
| 2010/0314817 | A1 | | 12/2010 | Li et al. | |
| 2013/0185926 | A1 | * | 7/2013 | Williams | B25B 5/147 29/559 |
| 2015/0202699 | A1 | * | 7/2015 | Makkonen | B25B 5/103 30/102 |

FOREIGN PATENT DOCUMENTS

| | | | |
|---|---|---|---|
| DE | 3121637 | A1 | 9/1982 |
| DE | 3532028 | A1 | 3/1987 |
| DE | 202014100000 | U1 | 4/2014 |
| EP | 1301311 | A1 | 4/2003 |
| WO | 2013/070203 | A2 | 5/2013 |

* cited by examiner

HOLDING APPARATUS FOR HOLDING A PIPE IN A ROTATABLE MANNER TO BE MACHINED

CROSS REFERENCE TO RELATED APPLICATIONS

This application is the National Stage of PCT/DE2015/100259 filed on Jun. 26, 2015, which claims priority under 35 U.S.C. § 119 of German Application No. 10 2014 109 150.7 filed on Jun. 30, 2014, the disclosures of which are incorporated by reference. The international application under PCT article 21(2) was not published in English.

BACKGROUND

The invention relates to a holding apparatus for holding a work piece to be machined, having a round and/or tubular cross-section, in such a manner that in the held state, the work piece can be rotated relative to the holding apparatus.

Such a holding apparatus can be used, for example, as a constituent of a circular saw for pipes. The pipe to be machined is fixed in place in such a manner that a rotational movement of the pipe relative to the holding apparatus is permitted for machining. Cutting through the pipe is carried out in that a saw unit having a saw blade is pressed against the outer circumference of the pipe, and then the entire circular saw for pipes is moved around the pipe, wherein the saw unit remains in active contact with the pipe.

SUMMARY

The holding apparatus usually has two clamping arms that are held on a base part so as to pivot, for gripping the pipe to be machined, which arms engage around at least part of the outside circumference of the pipe and exert a clamping force on the pipe. An adjustment mechanism is usually provided for moving the clamping arms in the direction toward the pipe.

An embodiment of the invention is based on the task of technically optimizing a holding apparatus having the characteristics stated initially. In particular, a holding apparatus having the characteristics stated initially is supposed to be made available, which apparatus allows fast release of the clamping arms out of clamping engagement on the work piece to be machined. In particular, a holding apparatus having the characteristics mentioned initially is supposed to be made available, the adjustment mechanism of which apparatus has a compact construction with regard to the clamping arms, and requires relatively little space for performing possible clamping movements.

This task is accomplished with a holding apparatus that has the characteristics of claim 1. Furthermore, the task is accomplished with holding apparatus that has the characteristics of claim 3. Advantageous embodiments of the invention are evident from the dependent claims, the following description, and the figures.

A holding apparatus for holding a work piece to be machined, the work piece having a round and/or tubular cross-section, in such a manner that in the held state, the work piece can be rotated relative to the holding apparatus, has at least two clamping arms mounted on a base part, by means of which arms a clamping force can be exerted on the work piece. In particular, at least part of the outside circumference surface of the work piece can be grasped by the clamping arms. In particular, the clamping force acts on the work piece as a holding force.

The holding apparatus furthermore has an adjustment mechanism for the clamping arms, the mechanism having a threaded spindle that can be manually activated and/or activated by means of an auxiliary force, which spindle is releasably in threaded engagement with a threaded part, such as a spindle nut, for example, wherein the threaded part is held on a component of the holding apparatus, particularly on the base part, so as to be fixed in place or fixed on the housing with reference to the base part, in the axial direction of the threaded spindle. In particular, the threaded spindle and the threaded part are releasably in threaded engagement with one another in the radial direction with reference to the threaded spindle.

In this way, a spindle drive is implemented for activation of the adjustment mechanism, which drive allows quick adjustment of the threaded spindle relative to the threaded part, in the axial direction. For this purpose, the threaded spindle is releasably held in threaded engagement with the threaded part. This is because the function of the spindle drive, as a screw gear mechanism, is put out of force by release of the threaded part from the threaded engagement with the threaded spindle, and the threaded spindle can be freely moved relative to the threaded part, in the axial direction. In this respect, this measure allows overly rapid release of the clamping arms from the clamping engagement on the work piece to be machined.

Supplementally or alternatively to this, the adjustment mechanism can have at least two drivers guided in straight manner. These drivers can drive clamping arms wherein, by means of the movements of these drivers, the clamping arms can be pivoted or are pivoted toward one another, if applicable by way of at least one intermediate element, such as, for example, an intermediate brace. Viewed in the direction transverse to the movement direction of the drivers, the drivers are disposed to lie one behind the other.

In this way, the adjustment mechanism of the holding apparatus is implemented in a technically simple manner. This is because adjustment of the clamping arms is brought about by means of a simple straight-line movement of the drivers. The drivers are preferably guided in a straight line by means of a corresponding guide, in order to guarantee that the drivers remain on their intended movement path.

Furthermore, the adjustment mechanism is configured to have a compact construction. This is because the expanse of the adjustment mechanism in the movement direction of the drivers is less, since the drivers lie one behind the other in the direction transverse to their movement direction, than if the drivers were to lie on a common line in the direction transverse to their movement direction. Also, the space requirement of the adjustment mechanism for performing the adjustment movement of the clamping arms is relatively slight. This is because in order to achieve a maximal adjustment, the drivers do not have to be pushed as far apart from one another than if the drivers were to lie on a common line in the direction transverse to their movement direction.

It can be provided that the drivers are mounted to be movable in the direction of the movement of the clamping arms, particularly that they are mounted to be essentially translationally movable. This measure also aims at configuring the adjustment mechanism so as to have a compact construction. This is because in this way, the drivers essentially move in the plane spanned by the movement of the clamping arms. For example, the drivers can be movable in such a manner that the movement of the drivers essentially takes place transverse to the axis of rotation of the clamping arms.

It is possible for the drivers, viewed transverse to their movement direction, to be arranged offset from one another. In this way, the drivers span a further distance in their movement direction, without the respective driver itself having a length over this distance. By means of the offset arrangement of the drivers, it is therefore possible, in simple manner and with a relatively small length expanse of the respective driver, to achieve a relatively great longitudinal expanse as a whole, by means of which coupling to the clamping arms, which are disposed at a distance from one another, is facilitated. This is because the distance between the coupling points of the respective clamping arm and driver is preferably dimensioned in such a manner that the work piece can be accommodated between them.

Of course, the drivers can also be disposed so as to essentially align with one another, viewed transverse to their movement direction.

It is possible that the drivers overlap, viewed in their movement direction. In this way, the drivers can be movement-coupled with one another in a technically simple manner, so that, for example, in the case of a movement of the one driver, movement of the other driver is also brought about at the same time. For example, the overlapping region can be utilized by a gear mechanism, in order to act both on the one driver and also on the other driver.

A possible embodiment of the invention consists in that the drivers are movement-coupled with one another by way of a reversal gear mechanism. In this way, it is guaranteed that the drivers can be moved both in the one direction and also in the other direction, in their movement guided in a straight line, and that one and the same gear mechanism, namely the reversal gear mechanism, is used for this purpose. By means of the reversal gear mechanism, it can be provided that the drivers can be moved toward one another and can also be moved away from one another.

According to a further embodiment of the invention, it is provided that the drivers each have gear-tooth systems, and, between them, a gear wheel that meshes with the gear-tooth systems, particularly a rotatable gear wheel, is provided. In particular, the gear wheel is held to be fixed in place or fixed on the housing with reference to the base part. In this way, movement coupling of the drivers with one another is implemented in a technically simple manner.

Alternatively to the gear wheel, a friction wheel can also be provided, which is disposed between the drivers and stands in active contact with a counter-friction surface of one of the drivers, in each instance. In particular, the friction wheel is fixed in place or fixed on the housing, with reference to the base part.

It can be provided that the gear-tooth systems or counter-friction surfaces are disposed laterally on the drivers and that the axis of rotation of the gear wheel or friction wheel lies essentially transverse to the movement direction of the drivers. In this way, movement coupling of the drivers can be implemented in a technically simple manner, by means of the gear wheel or friction wheel, if the drivers are disposed to lie one behind the other, viewed transverse to their movement direction, and lie in the region of the base part, so that the gear wheel or friction wheel can be mounted on the base part.

For example, it can be provided that at least one of the drivers has a gear rack or is configured as a gear rack. This measure is also aimed at implementing the movement coupling of the drivers in as technically simple a manner as possible.

According to a further embodiment of the invention, it is provided that the threaded spindle is connected to act with one of the drivers, in the axial direction, particularly that it engages on one of the drivers and/or is mounted on it, particularly mounted on it so as to rotate. In this way, transfer of the adjustment movement predetermined by the threaded spindle to the clamping arms is made possible in a technically simple manner. For this purpose, all that is required is coupling of the threaded spindle, in the direction of its longitudinal axis, with one of the drivers, if necessary by way of an intermediate element.

It is possible that the threaded part can be displaced in the radial direction with reference to the threaded spindle, particularly that is can be displaced in a compulsorily guided manner, and can be brought out of threaded engagement by means of displacement in the radial direction. In this way, the threaded part can be brought out of engagement with the threaded spindle in technical simple manner. Releasing the threaded part from the threaded engagement with the threaded spindle, and also bringing the threaded part into threaded engagement with the threaded spindle, can be carried out in a operationally reliable and easily handled manner, in that the threaded part is compulsorily guided.

In simple manner, the threaded part can be brought out of engagement with the threaded spindle if the threaded part engages around the threaded spindle over a circumference section that extends at most over half the circumference of the threaded spindle. Then, the threaded part is present only in a small section, particularly a circular section, and can be released from the threaded spindle by means of radial displacement.

According to a further embodiment of the invention, an activation element that can be manually activated and/or activated by means of an auxiliary force is provided. This activation element through the auxiliary force, can bring the threaded part out of threaded engagement with the threaded spindle, counter to the force of a spring element, for example. In this way, the threaded part can be released from the threaded engagement with the threaded spindle, in an easy to handle manner.

If a spring element is provided, counter to the force of which the activation element is activated to bring the threaded part out of threaded engagement with the threaded spindle, the threaded part is automatically brought back into the threaded engagement by means of the reset force of the spring element when activation of the activation element has ended. For example, the activation element can be configured as a pressure element, particularly a push button, which brings the threaded part out of threaded engagement with the threaded spindle, counter to the force of a spring element, by means of a pressure force exerted by a user.

It is possible that the activation element is firmly connected with the threaded part by way of at least one connection element; in particular, the connection element should be displaceably guided on the component on which it is fixed in place, or on the base part. In this way, reliable and permanent functioning of the activation mechanism is guaranteed, in order to bring the threaded part out of engagement with the threaded spindle and also to guide it reliably back into threaded engagement.

Furthermore, the invention comprises an apparatus for machining a work piece that has a round and/or tubular cross-section, having a holding apparatus of the type described above.

In particular, the apparatus has a machining unit that is held on the base part of the holding apparatus so as to pivot, and can be brought in the direction toward a work piece held in the holding apparatus by means of pivoting.

The apparatus can be configured for processing of the work piece by machine. The processing unit is then configured as a machine unit.

It can be provided that the machining unit is configured for cutting the work piece and/or chamfering or beveling an end of the work piece. For example, the machining unit can have a circular saw or be configured as a circular saw, for example having at least one blade or saw blade.

Furthermore, it is possible that the apparatus is configured as a hand tool.

Further goals, advantages, characteristics, and application possibilities of the present invention are evident from the following description of an exemplary embodiment, using the drawings. In this regard, all the characteristics described and/or shown in the figures form the object of the present invention, by themselves or in any desired practical combination, also independent of how they are combined in the claims or their antecedents.

BRIEF DESCRIPTION OF THE DRAWINGS

Other objects and features of the present invention will become apparent from the following detailed description considered in connection with the accompanying drawings which disclose at least one embodiment of the present invention. It should be understood, however, that the drawings are designed for the purpose of illustration only and not as a definition of the limits of the invention.

In the drawings, wherein similar reference characters denote similar elements throughout the several views.

DETAILED DESCRIPTION

Figure 1:
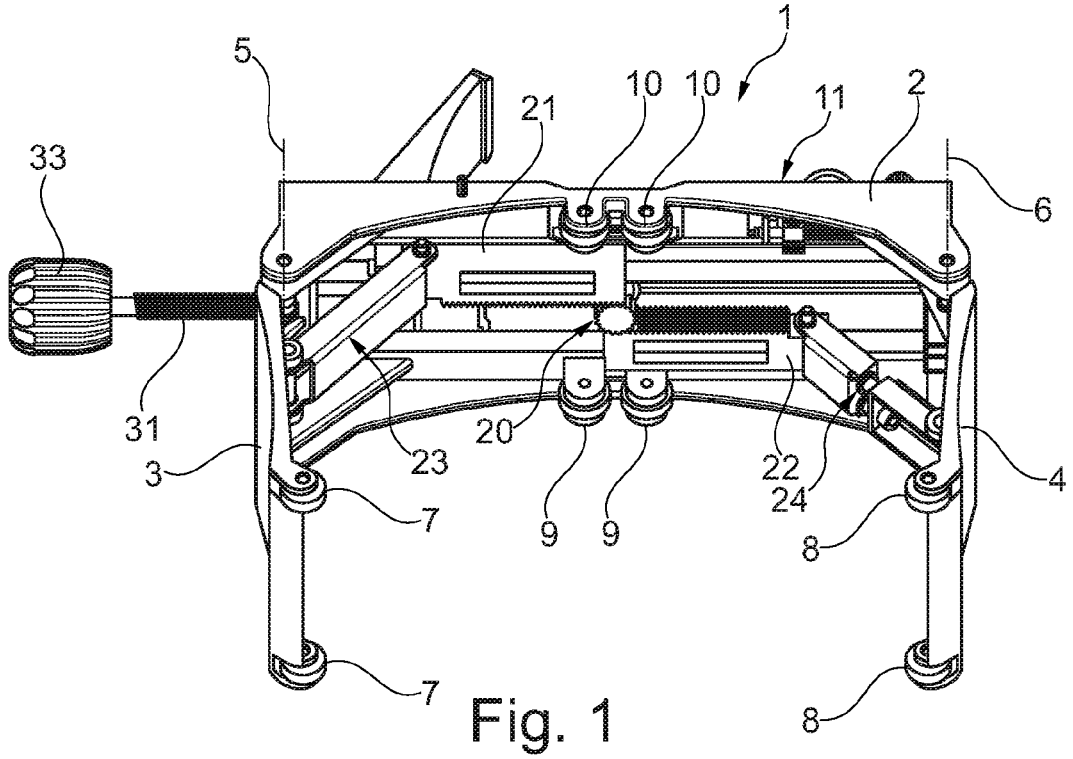
FIG. 1 a possible embodiment of a holding apparatus for rotatable holding of a work piece to be machined, having a round and/or tubular cross-section, in a perspective representation from below, FIG. 2 an enlarged detail from FIG. 1 in the region of an adjustment mechanism of the holding apparatus according to FIG. 1, FIG. 3 a region of the adjustment mechanism of the holding apparatus according to FIG. 1, seen as a view from above, FIG. 4 the holding apparatus according to FIG. 1 in the region of an activation device for the adjustment mechanism and a quick-adjustment unit, FIG. 5 an enlarged detail of the activation device according to FIG. 4 in the region of the quick-adjustment unit, as a sectional representation, FIG. 6*a* the activation device according to FIG. 4 in an open position of the quick-adjustment unit, FIG. 6*b* the activation device according to FIG. 4 in a closed position of the quick-adjustment unit, FIG. 7 an enlarged detail from FIG. 1 in the region of a transition from the adjustment mechanism to one of the clamping arms for holding the work piece, in a perspective representation, FIG. 8 a further possible embodiment of a holding apparatus for rotatable holding of a work piece to be machined, having a round and/or tubular cross-section, in a detail view from below, onto a region of an adjustment mechanism, FIG. 9 a top view of a hand-held circular saw having a holding apparatus according to FIG. 1, and FIG. 10 a hand-held circular saw according to FIG. 9 in a sectional representation.

FIG. 1 shows—in a schematic representation—a possible embodiment of a holding apparatus 1 for holding a work piece to be machined, having a round and/or tubular cross-section, in such a manner that in the held state, the work piece can be rotated relative to the holding apparatus 1. In other words, the holding apparatus 1 can be attached to a round and/or tubular work piece that is to be machined (not shown in FIG. 1), such as a pipe, for example, so as to rotate around it. Rotation proceeds in such a manner that the holding apparatus 1 remains stationary in the axial direction of the work piece.

Preferably, the holding apparatus 1 has multiple roller bodies 7, 8, 9, and 10, which are mounted so as to rotate, for example. The roller bodies 7, 8, 9, and 10 act in supporting manner, so that the holding apparatus 1 can be rotated in a plane perpendicular to the center axis of the work piece when they are pressed against the outer surface of the work piece. The roller bodies 7, 8, 9, and 10 can be provided in the axial direction of the work piece, at least in pairs.

The holding apparatus 1 comprises a base part 2 and at least two clamping arms 3, 4, which proceed from there. Preferably, the clamping arms 3, 4 are held on the base part 2 so that they can pivot in the direction toward one another, for example in that the pivot arms 3, 4 are articulated onto the base part 2 with one end. The base part 2 can be formed by a frame profile, housing or the like. Preferably, the base part 2 has a base plate 11, so that a machining unit for machining the work piece can be disposed on top of or on the side of the plate.

The clamping arms 3 and 4 are configured in such a manner and disposed on the base part 2 in such a manner that at least a part of the outside circumference surface of the work piece can be encompassed. Preferably, for this purpose the clamping arms 3 and 4 can be rotated about a related axis of rotation 5 and 6, respectively, in each instance, wherein the axes of rotation 5, 6 are disposed at a distance from one another, preferably run essentially parallel to one another, and preferably lie essentially parallel to the center axis of the work piece.

The clamping arms 3 and 4 are designed for exerting a holding force, preferably a clamping force on the work piece, wherein the rotatability of the work piece relative to the holding apparatus 1 is maintained. For this purpose, at least one of the roller bodies 7, 8, 9, 10 is disposed on each of the clamping arms 3, 4, which body can be provided in the region of the free end of the clamping arms 3, 4, for example. Preferably, further roller bodies 7, 8, 9, 10 are disposed on the base part 2 in the region between the clamping arms 3, 4.

The holding apparatus 1 has an adjustment mechanism 20 for the clamping arms 3, 4. The adjustment mechanism 20 comprises two drivers 21 and 22, and the clamping arms 3 and 4 can be pivoted toward one another by the movement of the drivers. Preferably, the drivers 21 and 22 are movement-coupled with the related clamping arm 3 or 4 by way of an intermediate element 23 or 24, respectively, for this purpose, for example in that the respective driver 21 or 22 is articulated onto the related intermediate element 23 or 24, the respective intermediate element 23 or 24 in turn is articulated onto the related clamping arm 3 or 4, and preferably, the respective intermediate element 23 or 24 is disposed at an angle relative to the related driver 21 or 22. The intermediate elements 23 and 24 can be configured in the manner of an elongated or ridge-like connection part or a strut, in each instance, or can have such a part.

Figure 2:
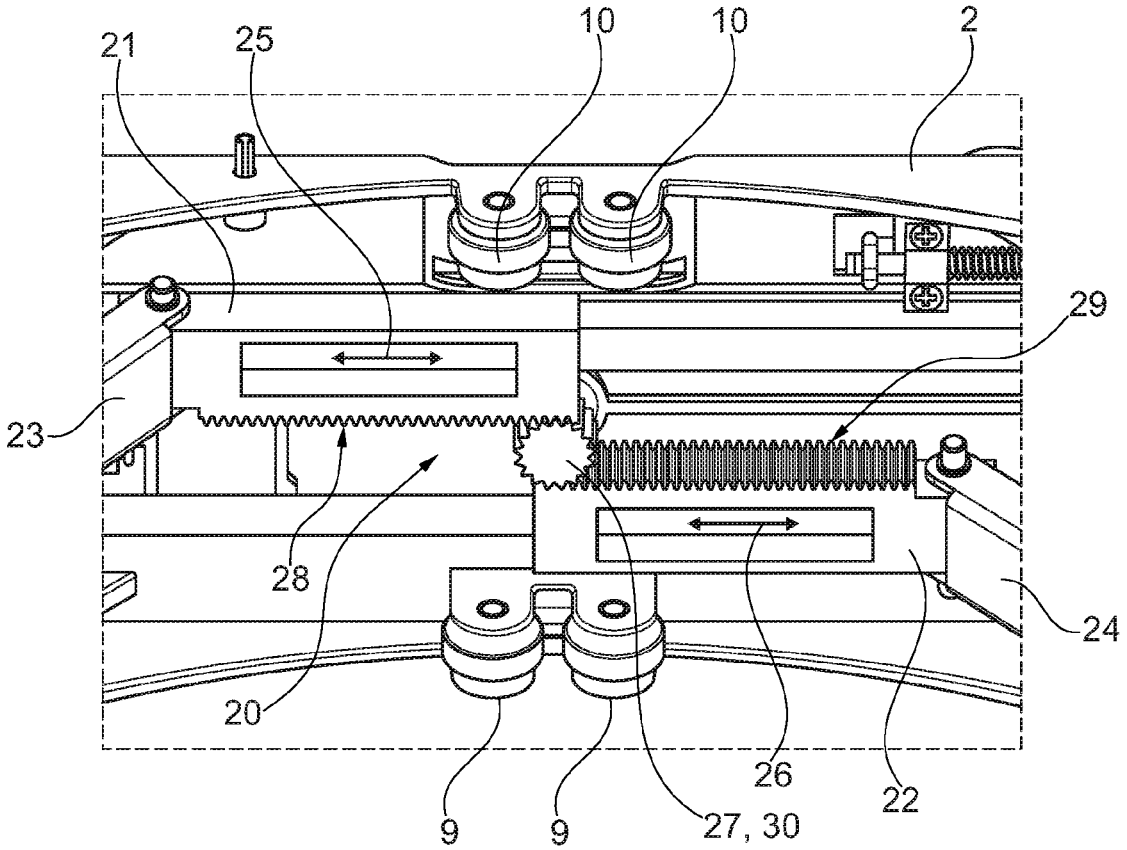

FIG. 2, in an enlarged detail, shows the region of the holding apparatus 1 having the adjustment mechanism 20. The adjustment mechanism 20 is configured in such a manner that in order to adjust the clamping arms 3 and 4, the drivers 21 and 22 perform an essentially straight-line adjustment movement (straight line adjustment movements 25 and 26), in each instance. Preferably, in this connection the drivers 21 and 22 move on a respective movement path, which paths lie essentially parallel to one another. Viewed in the direction transverse to the movement direction of the adjustment movement (straight line adjustment movements 25, 26) of the drivers 21 and 22, the drivers 21 and 22 are disposed to lie one behind the other and offset from one another, wherein the drivers 21 and 22 overlap over a section. This overlap section is used to provide a movement element 27 in between, by way of which element the drivers 21 and 22 are movement-coupled with one another. The movement element 27 is fixed in place on a component of the holding apparatus 1, with reference to the base part 2, so as to rotate about itself; in particular, it is mounted on the base part 2 so as to rotate.

The movement coupling of the drivers 21 and 22 can be implemented in such a manner that the drivers 21 and 22 each have gear-tooth systems 28, 29, and that a gear wheel 30 that meshes with the gear-tooth systems 28 and 29 is provided in between, which gear wheel forms the movement element 27. In this way, a reversal gear mechanism is formed, by means of which the drivers 21 and 22 can be moved in the direction toward one another and also in the direction away from one another, so that the clamping arms 3 and 4 can be moved both in the direction toward a work piece to be machined and also in the direction away from the work piece to be machined, without additional measures, by means of this reversal gear mechanism.

For this purpose, the drivers 21 and 22 can each be configured as a gear rack or can have a gear rack. Also, it can be provided that the drivers 21 and 22 have depressions, notches or passage openings, for example are configured as a hollow structure, so that the drivers 21 and 22 are relatively light, in terms of weight.

Preferably, the drivers 21 and 22 are guided in terms of their movement, particularly compulsorily guided. For this purpose, a guide 45 or 46 or one single guide, in each instance, can be provided, as is evident from FIG. 3. There, the holding apparatus 1 is shown as a detail in the region of the adjustment mechanism 20, in a view from above onto the holding apparatus 1, wherein the base part 2 has been left out for the sake of simplicity.

The guide 45 for the driver 21 and the guide 46 for the driver 22 can be formed by a guide element 47, 48, in each instance, on which the driver 21 or 22 slides during the course of its adjustment movement, guided in a straight line in the movement direction 60. For example, the respective guide element 47, 48 can be configured as a rod, over which the related driver 21 or 22 is pushed. For this purpose, the related driver 21 or 22 can have a passage channel, a passage opening or the like, through which the rod projects, so that the driver 21 or 22 is guided so as to be displaceable by means of the related rod. Preferably, the respective guide element 47 or 48 is disposed on a component of the holding apparatus 1, fixed in place or fixed on the housing with reference to the base part 2, particularly attached to the base part 2.

A threaded spindle 31 is provided for adjusting the drivers 21 and 22, as is evident from FIG. 1, for example. The threaded spindle 31 can be configured for manual activation by way of an activation element 33, such as a rotary button, for example. Also, the threaded spindle 31 can be configured so that it can be activated by means of an auxiliary force.

Figure 3:
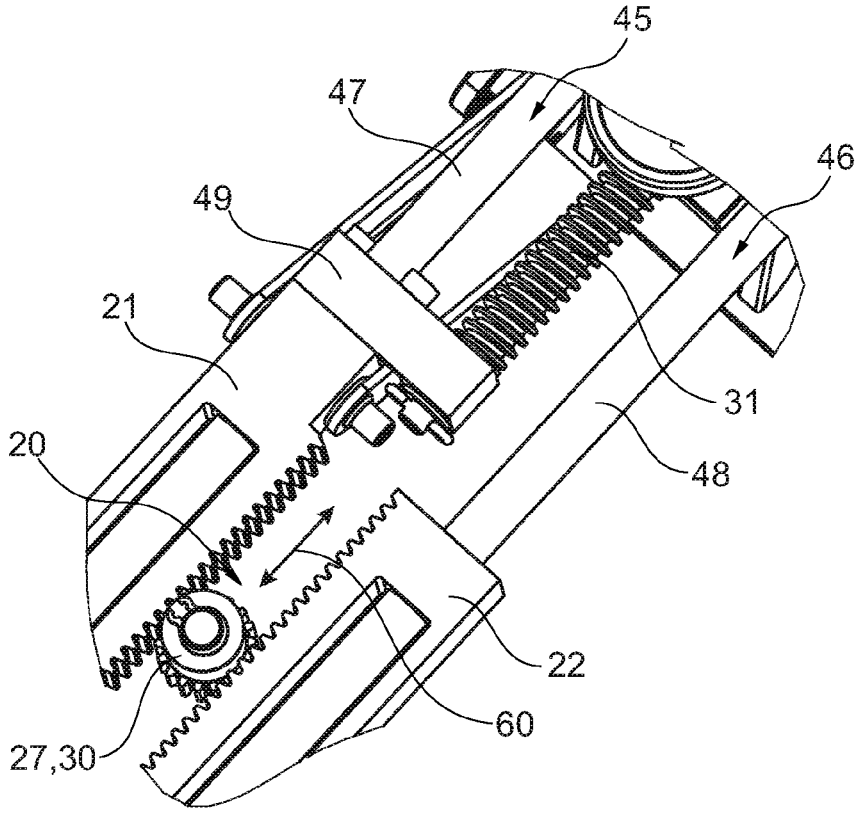

Preferably, the threaded spindle 31 is movement-coupled with one of the drivers 21, 22. For this purpose, an intermediate element 49 can be provided, on which the threaded spindle 31 engages, particularly is mounted so as to rotate, wherein the intermediate element 49 is firmly connected with the driver 21 (FIG. 3). For example, the threaded spindle 31 is disposed between the drivers 21 and 22 in the longitudinal direction. The intermediate element 49 then serves to bridge the transverse offset of the threaded spindle 31 relative to the driver 21, with which the threaded spindle 31 is movement-coupled with regard to the adjustment movement.

Figure 4:
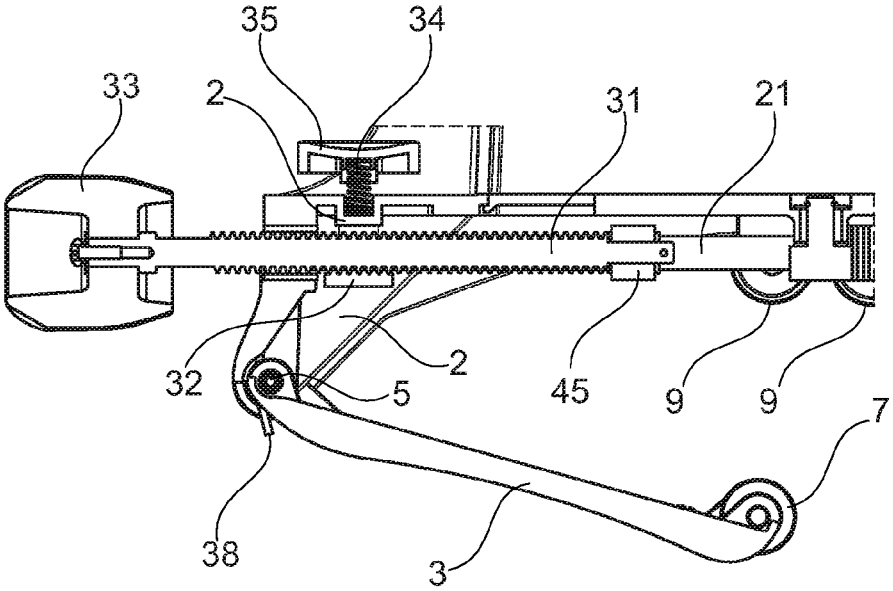

FIG. 4, in a sectional representation, shows the holding apparatus 1 in the region of the threaded spindle 31. As is evident from this, the threaded spindle 31, with its thread, is in threaded engagement with a threaded part 32, which has a counter-thread. The threaded part 32 is fixed on a component of the holding apparatus 1, so as to be fixed in place with regard to the base part 2, in the axial direction of the threaded spindle 31, for example fixed on the base part 2 itself.

An advancing movement of the threaded spindle 31 in the axial direction and thereby an adjustment movement of the driver 21 coupled with it comes about by means of rotating the threaded spindle 31 relative to the threaded part 32. The adjustment movement initiated by the threaded spindle 31 is transferred to both clamping arms 3 and 4 by means of the movement coupling of the driver 21 with the driver 22, by way of the movement element 27, so that in this way, the clamping arms 3 and 4 can be brought into a closed position with regard to a work piece to be machined, by means of the threaded spindle 31, or, by means of opposite activation of the threaded spindle 31, the clamping arms 3 and 4 can be brought into an open position with regard to the work piece to be machined.

In order to accelerate opening and closing by means of the threaded spindle 31, the holding apparatus 1 has a quick-adjustment unit. The quick-adjustment unit is formed in that the threaded part 32 can be brought out of threaded engagement relative to the threaded spindle 31 by means of radial displacement. Preferably, the counter-thread of the threaded part 32 is merely configured over a circumference section for this purpose, in order to allow the radial displacement of the threaded part 32 relative to the threaded spindle 31. In that the threaded part 32 comes out of engagement with the threaded spindle 31, displacement of the threaded spindle 31 relative to the fixed-in-place threaded part 32 and thereby adjustment of the drivers 21, 22 can be carried out, without the threaded spindle 31 having to be rotated for this purpose.

Figure 5:
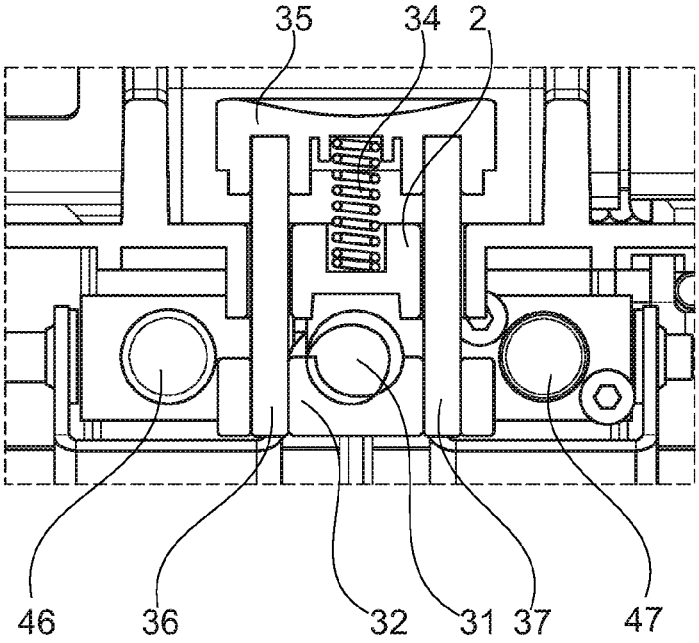

FIG. 5, in a detail, shows the method of activation for bringing the threaded part 32 out of engagement with the threaded spindle 31. As is evident from this and, in particular, from FIG. 4, the threaded part 32 is held in threaded engagement with the threaded spindle 31 by means of the bias force of a spring element 34. In the case of radial displacement of the threaded part 32 relative to the threaded spindle 31, the threaded part 32 is brought out of threaded engagement counter to the force of the spring element 34, so that the threaded part 32 moves back into threaded engagement with the threaded spindle 31, by means of the reset force of the spring element 34, if, for example, the activation force for releasing the threaded part 32 has been cancelled out.

In order to displace the threaded part 32 in the radial direction and to bring it out of threaded engagement, an activation element 35 can be provided, which is a pressure element that can be manually activated, for example, so that the threaded part 32 is brought out of threaded engagement with the threaded spindle 31 by means of pressing the activation element 35. For this purpose, the threaded part 32 is firmly connected with the activation element 35, preferably by way of at least one or at least two connection elements 36 and 37, and guided in the axial displacement movement on a component provided in a fixed location relative to the base part 2.

For example, the guide can be formed by a section of the base part 2 itself, wherein the spring element 34 is situated between the activation element 35 and the section of the base part 2. In order to accelerate opening of the holding apparatus 1, it can furthermore be provided that the clamping arms 3 and 4 are automatically moved to their open position by means of the force of a further spring element 38 when the threaded part 32 is brought out of threaded engagement with the threaded spindle 31. The further spring element 38 can be configured as a torsion spring, which is disposed, for example, in the region of the respective axis of rotation 5 or 6 of the clamping arm 3 or 4, respectively.

Figure 6A:
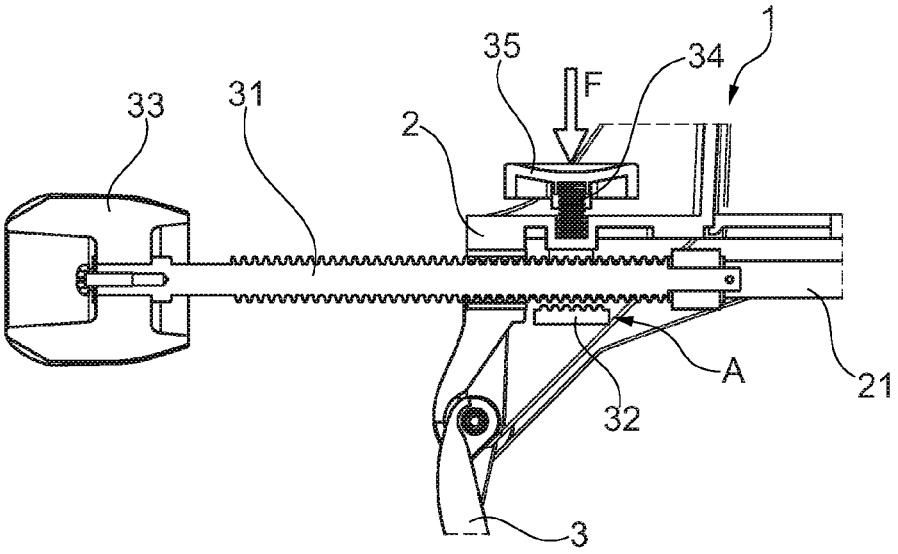
Figure 6B:
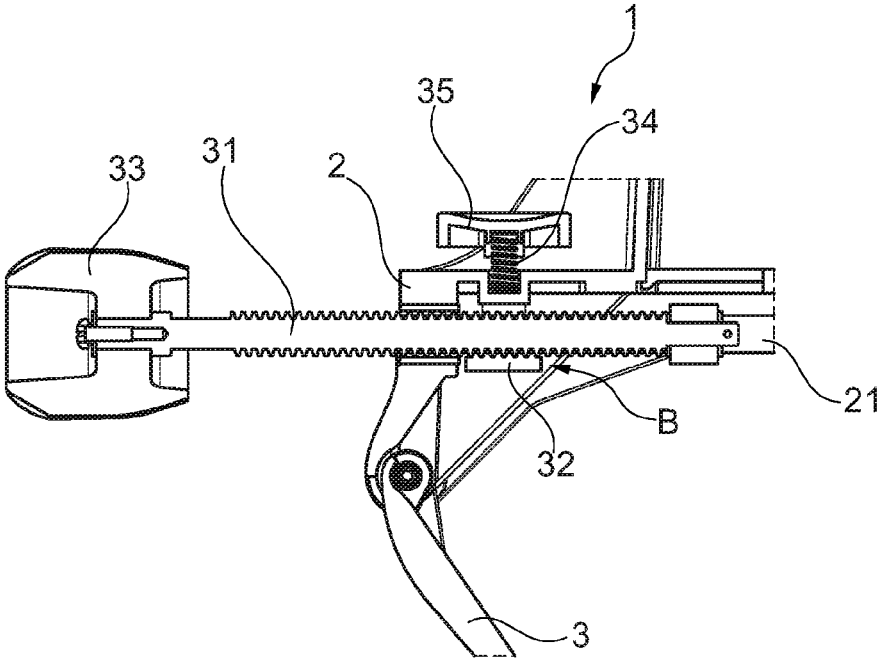

FIGS. 6*a* and 6*b* show the holding apparatus 1 in the region of the threaded spindle 31 and of the quick-adjustment unit, as a sectional representation, in each instance, once in the open position A (FIG. 6*a*) and once in a closed position (FIG. 6*b*). The open position A is achieved by means of the quick-adjustment unit, in that a pressure force F is exerted on the activation element 35, and thereby the threaded part 32 comes out of engagement with the threaded spindle 31. Opening of the clamping arms 3 and 4 and thereby a movement of the drivers 21 and 22 away from one another automatically comes about by means of the force of the further spring elements 38 (FIG. 4).

The clamping arms 3 and 4 are moved in a direction toward one another and thereby the closed position B relative to a work piece to be held is achieved, if, according to FIG. 6*b*, the threaded part 32 is present in threaded engagement with the threaded spindle 31, in other words the pressure force F has been taken away from the activation element 35. The threaded spindle 31 can then be rotated while in threaded engagement with the threaded part 32, and pushes the driver 21 and, by way of the movement element 27, also the driver 22 in the direction toward one another.

Figure 7:
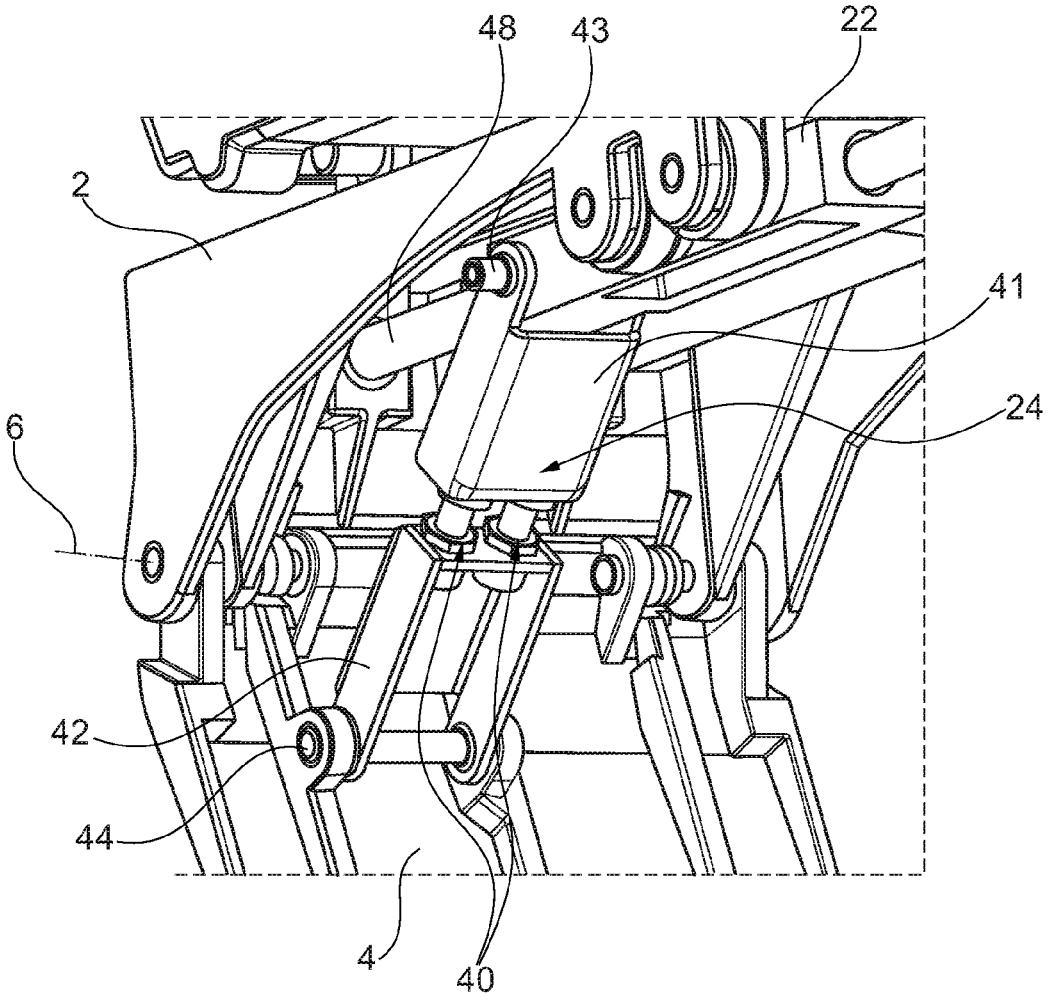

FIG. 7 shows a possible embodiment of at least one of the intermediate elements 23 and 24, by means of which elements the drivers 21 and 22 are movement-coupled with the related clamping arm 3 or 4, respectively, using the example of the intermediate element 24 for the clamping arm 4.

The intermediate element 24 has two length sections 41 and 42, between which at least one, preferably two setting devices 40 are provided, in order to be able to change the distance of the length sections 41 and 42 relative to one another. In this way, the length of the intermediate element 24 between the articulation point 43 relative to the driver 22 and the articulation point 44 relative to the clamping arm 4 can be changed. By means of the length change of the intermediate element 24, precise adjustment of the position of the drivers 21 and 22 relative to the position of the clamping arms 3 and 4 can be carried out. The setting device 40 can be formed by a screw, for example, which is screwed into a thread, for example on a nut disposed on one of the length sections 41 or 42, to a greater or lesser extent. One or more counter-nuts can also be provided there for locking.

Figure 8:
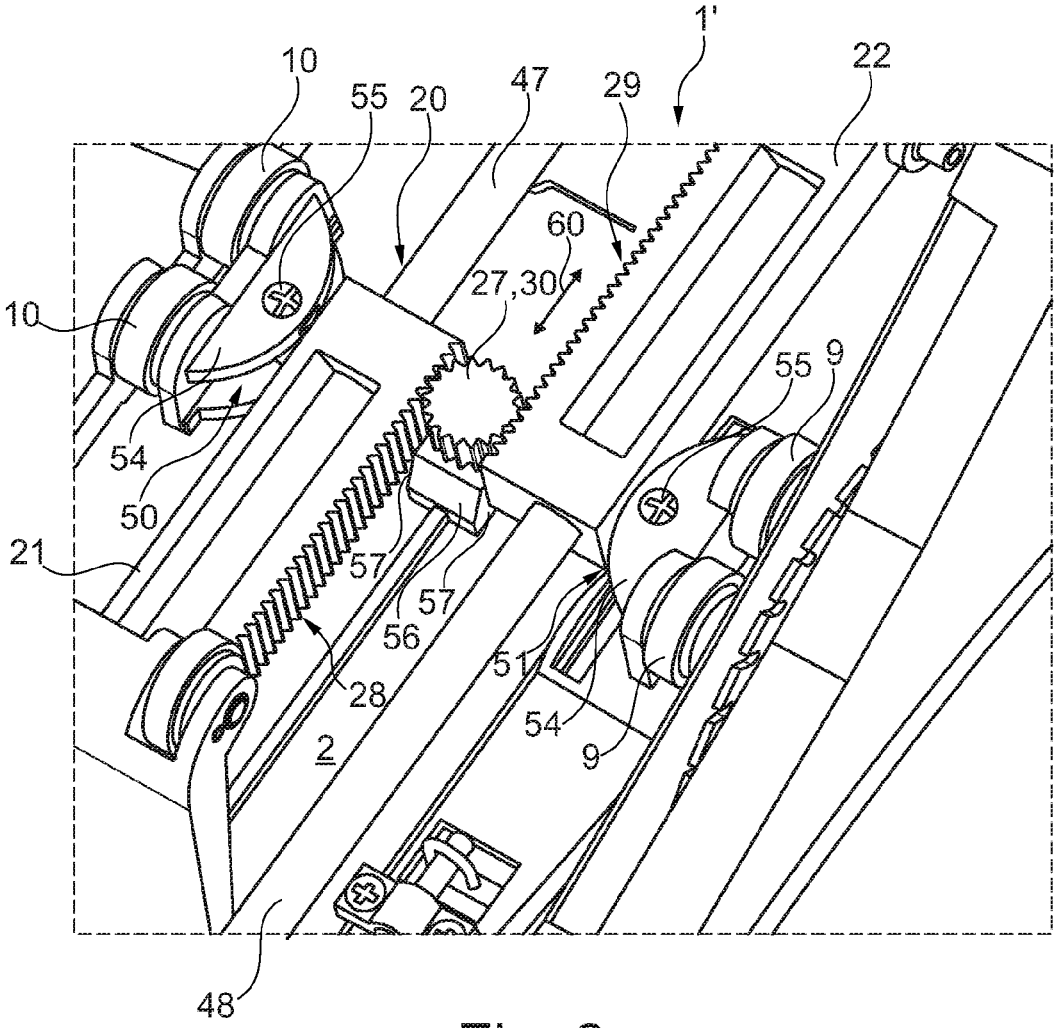

FIG. 8 shows a further possible embodiment of a holding apparatus 1' for rotatable holding of a work piece to be machined, having a round and/or tubular cross-section. There, the holding apparatus 1' is shown in a detail view from below of a region of the adjustment mechanism 20. Components of the holding apparatus 1' according to FIG. 8, which are identical to or functionally equivalent with components of the holding apparatus 1 according to the previous figures, are provided with the same reference symbols; in this respect, reference is made to the description of the holding apparatus 1.

The holding apparatus 1' according to FIG. 8 differs from the holding apparatus 1, among other things, in that counter-holders 50, 51 or thrust bearings for the drivers 21, 22 are provided, by means of which a movement of the drivers 21, 22 transverse to the movement direction 60 of the adjustment movement and thereby slip between the drivers 21, 22 and the gear wheel 30 are prevented. Viewed transverse to the movement direction 60 of the drivers 21, 22, the counter-holders 50, 51 are preferably disposed in the region of the gear wheel 30. For example, the driver 21 is situated between the counter-holder 50 and the gear wheel 30, and the driver 22 is situated between the counter-holder 51 and the gear wheel 30.

The counter-holders 50, 51 can be formed by a rotationally movable rolling part 55 or a torque-proof sliding part, which is mounted on a part 54 that is fixed on the housing, for example the bearing part for the rollers 9 and 10. Supplementally, further counter-holders or thrust bearings can be provided, which serve as a stop or restriction for the drivers 21, 22 on the side having the gear-tooth system 28 or 29. For example, the further counter-holders are formed by a common material projection 56 on a component fixed on the housing, particularly the base part 2. There, a contact surface 57 that serves as a counter-holder or thrust bearing can provided, in each instance.

Figure 9:
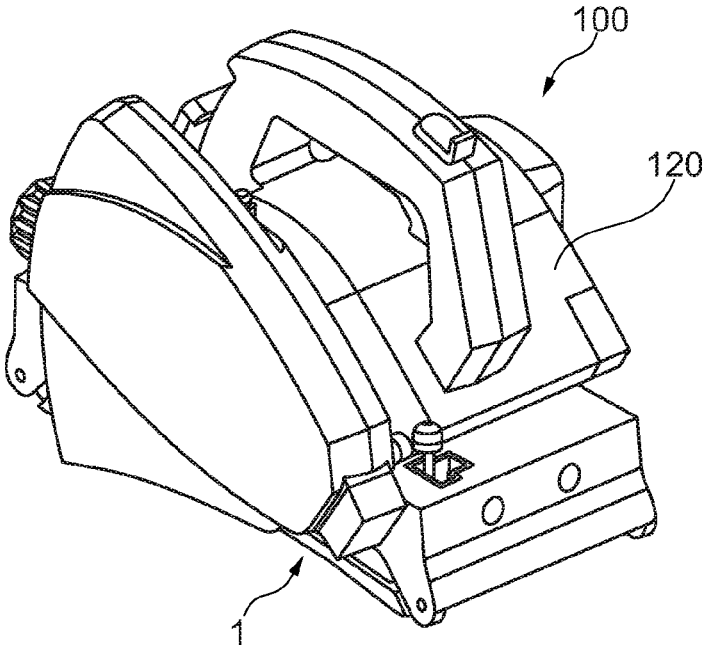
Figure 10:
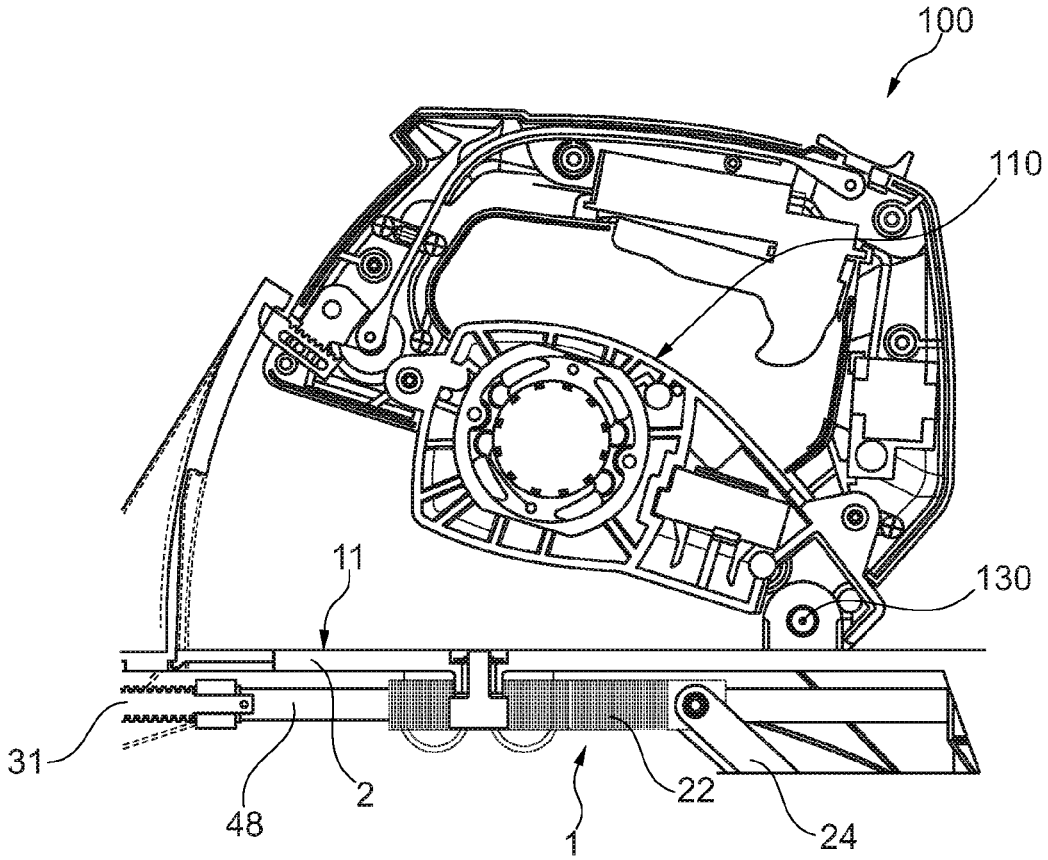

FIGS. 9 and 10 show a possible application of the holding apparatus 1 according to FIG. 1. There, the holding apparatus 1 is a constituent of an apparatus 100 for machining of work pieces having a round and/or tubular cross-section, such as pipes, for example. FIG. 9 shows the apparatus 100 in a view from above. FIG. 10 shows the apparatus 100 in a sectional representation. Alternatively to the holding apparatus 1, the apparatus 100 can also have the holding apparatus 1' according to FIG. 8.

The apparatus 100 has a machining unit 110, which can be covered by a housing 120, at least in part, toward the outside. Preferably, the machining unit 110 is mounted on the base part 2 or the base plate 11 of the holding apparatus 1 so as to pivot about an axis of rotation 130, in order to move the machining unit 110 to or away from the work piece to be machined, which is held in the holding apparatus 1 for machining.

The machining unit 110 can be configured as a processing unit that is part of a machine, Pivoting of the machining unit 110 toward the work piece or away from the work piece can be performed manually. For example, the machining unit 110 is configured as a circular saw for cutting the work piece to be machined to length.

The apparatus 100 preferably functions as follows: The holding apparatus 1, together with the machining unit 110, is fitted around the work piece to be machined, at a desired machining point, and the holding apparatus 1 is attached in this position by means of the threaded spindle 31. The drivers 21 and 22 perform a setting movement by means of the rotation of the threaded spindle 31, thereby moving the clamping arms 3 and 4 toward the work piece to be machined and bringing them into a clamping position relative to the work piece.

When the holding apparatus 1 is attached to the work piece, the machining unit 110 can be pivoted toward the work piece about the axis of rotation 130, so that the machining unit 110 can begin or does begin with machining of the work piece. Then, rotation of the holding apparatus 1, together with the machining unit 110, around the work piece, in the direction of the rolling path established by the clamping arms 3 and 4 and the roller bodies 7, 8, 9, and 10 follows.

After machining of the work piece, the machining unit 110 is pivoted away from the work piece, and the work piece is released from the holding apparatus 1. For this purpose, the quick-adjustment unit can be activated, for one thing, in that the activation element 35 is pressed and the threaded part 32 comes out of engagement with the threaded spindle 31, and thereby the clamping arms 3 and 4 are automatically moved into the open position A, by means of the spring force of further spring elements 38. Alternatively, it is also possible that the threaded spindle 31 is rotated during threaded engagement of the threaded part 32, and thereby the clamping arms 3 and 4 are moved apart from one another by way of the drivers 21 and 22.

REFERENCE SYMBOL LIST

1 holding apparatus
2 base part
3 clamping arm
4 clamping arm
5 axis of rotation
6 axis of rotation
7 roller body
8 roller body
9 roller body
10 roller body
11 base plate
20 adjustment mechanism
21 driver
22 driver
23 intermediate element
24 intermediate element
25 straight line adjustment movement
26 straight line adjustment movement
27 movement element
28 gear-tooth system
29 gear-tooth system
30 gear wheel
31 threaded spindle
32 threaded part
33 activation element
34 spring element
35 activation element
36 connection element
37 connection element
38 further spring element
40 setting device
41 length section
42 length section
43 articulation point
44 articulation point
45 guide
46 guide
47 guide element
48 guide element
49 intermediate element
50 counter-holder
51 counter-holder
54 part fixed in place on housing
55 rolling part
56 material projection
57 contact surface
60 movement direction
100 apparatus
110 machining unit
120 housing
130 axis of rotation A open position B closed position

The invention claimed is:

1. A holding apparatus for rotatable holding of a work piece to be machined, the work piece having a round or tubular cross-section, the holding apparatus comprising:
- a base part;
- a plurality of stationary roller bodies rotatably arranged in a fixed position on the base part;
- at least two clamping arms pivotally mounted to the base part;
- a plurality of pivoting roller bodies, at least one of said pivoting roller bodies being rotatably arranged on each of the at least two clamping arms; and
- an adjustment mechanism for adjusting the at least two clamping arms, the adjustment mechanism having
  - a threaded spindle which is operatively connected to the at least two clamping arms and configured to pivot the at least two clamping arms upon axial movement of the threaded spindle,
  - a threaded part configured to radially engage and disengage the threaded spindle while maintaining an axially fixed position relative to the base part, and
  - an activation element which is firmly connected to the threaded part by a connecting element and outwardly biased by a spring,
- wherein the threaded part and the activation element are arranged on opposite sides of the threaded spindle,
- wherein the at least two clamping arms allow a clamping force to be exerted on the work piece,
- wherein by means of said plurality of stationary roller bodies and said plurality of pivoting roller bodies the work piece can be rotated relative to the holding apparatus when the work piece is in a held state,
- wherein the threaded part limits axial movement of the spindle to axial movement caused by rotating the threaded spindle when the threaded part is in an engaged position in which the threaded part meshes with the threaded spindle, and
- wherein the threaded spindle is free to move axially without rotating when the threaded part is in a disengaged position, in which the threaded part does not mesh with the threaded spindle.

2. The holding apparatus according to claim 1, wherein the threaded part is displaceable in a radial direction with reference to the threaded spindle and can be brought out of threaded engagement by means of displacement in the radial direction.

3. An apparatus for machining a work piece having a round or tubular cross-section, said apparatus comprising:
- i) a holding apparatus according to claim 1, for holding the work piece to be machined; and
- ii) a machining unit that is pivotally held on the base part of the holding apparatus and can be pivoted in a direction toward the work piece held in the holding apparatus.

4. The apparatus according to claim 3, wherein the machining unit is pivotally disposed on or to a base plate of the holding apparatus on a side of the base plate opposite the clamping arms.

5. The holding apparatus according to claim 1, wherein a base plate of the holding apparatus is configured to dispose a machining unit thereon or thereto to be pivoted in a direction toward the work piece held in the holding apparatus.

6. The holding apparatus as in claim 1,
wherein each of the at least two clamping arms extends from a first end to a second end and is pivotally mounted to the base part at the respective first end, and
wherein the at least one pivoting roller body rotatably arranged on each of the at least two clamping arms is arranged at the respective second end.

7. The holding apparatus as in claim 1,
wherein the adjustment mechanism has two drivers,
wherein each of said two drivers is
movement-coupled with one of the at least two clamping arms and further
mounted to the base part and guided by a guide so as to move translationally in a direction transverse to the axis of rotation in order to pivot the two clamping arms toward one another by a translationally adjusting movement of the two drivers, and
wherein the guide is disposed on a component of the holding apparatus fixed in place with reference to the base part.

8. The holding apparatus as in claim 7,
wherein the two drivers are connected to the two clamping arms by two intermediate elements,
wherein at least one of the two intermediate elements has two length sections connected to one another by a setting device configured to change a distance between the two length sections.

9. A holding apparatus for rotatable holding of a work piece to be machined, the work piece having a round or tubular cross-section, the holding apparatus comprising:
a base part;
a plurality of stationary roller bodies rotatably arranged in a fixed position on the base part;
two clamping arms, each mounted to the base part pivotally about an axis of rotation;
a plurality of pivoting roller bodies, at least one of said pivoting roller bodies being rotatably arranged on each of the two clamping arms; and
an adjustment mechanism for adjusting the two clamping arms, the adjustment mechanism having two drivers which are respectively movement-coupled with one of the two clamping arms each in order to pivot the two clamping arms toward one another by an adjusting movement of the two drivers,
wherein the two drivers are arranged on two parallel guides that are fixedly arranged relative to the base part at a distance from one another and guide the two drivers to move in straight manner during the course of their adjustment movement, the guides being positioned so as to overlap in their movement direction,
wherein the two clamping arms allow a clamping force to be exerted on the work piece,
wherein by means of said plurality of stationary roller bodies and said plurality of pivoting roller bodies the work piece can be rotated relative to the holding apparatus when the work piece is in a held state,
wherein the two drivers are connected to the two clamping arms by two intermediate elements, and
wherein at least one of the two intermediate elements has two length sections connected to one another by a setting device configured to change a distance between the two length sections.

10. The holding apparatus according to claim 9, wherein the two drivers are mounted to move in a direction of the movement of the two clamping arms.

11. The holding apparatus according to claim 9, wherein the two drivers are movement-coupled with one another by a reversal gear mechanism.

12. The holding apparatus according to claim 9, wherein the two drivers each have a gear-tooth system and wherein a rotating gear wheel that meshes with the gear-tooth systems is provided in between the two drivers; said gear wheel is held fixed in place with reference to the base part.

13. The holding apparatus according to claim 9, further comprising a threaded spindle that can be manually activated or activated by means of an auxiliary force, wherein said threaded spindle is releasably in threaded engagement with a threaded part, wherein the threaded part is held on a component of the holding apparatus fixed in place with reference to the base part, in an axial direction of the threaded spindle.

14. The holding apparatus according to claim 13,
wherein,
when the threaded part is in an engaged position in which the threaded part meshes with the threaded spindle, the threaded part limits axial movement of the spindle to axial movement caused by rotating the threaded spindle, and
when the threaded part is in a disengaged position, in which the threaded part does not mesh with the threaded spindle, the threaded spindle is free to move axially without rotating.

15. The holding apparatus according to claim 13, wherein the threaded spindle is connected to act with one of the two drivers by engaging one of the two drivers or is mounted on one of the two drivers.

16. The holding apparatus according to claim 13, wherein the threaded part is displaceable in a radial direction with reference to the threaded spindle and can be brought out of threaded engagement by means of displacement in the radial direction.

17. The holding apparatus according to claim 13, further comprising an activation element that can be manually activated or activated by means of an auxiliary force, by activating the activation element the threaded part can be brought out of engagement with the threaded spindle, counter to a force of a spring element.

18. An apparatus for machining a work piece having a round or tubular cross-section, said apparatus comprising:
i) a holding apparatus according to claim 9, for holding the work piece to be machined; and
ii) a machining unit that is pivotally held on the base part of the holding apparatus and can be pivoted in a direction toward the work piece held in the holding apparatus.

19. A holding apparatus for rotatable holding of a work piece to be machined, the work piece having a round or tubular cross-section, the holding apparatus comprising: a base part; a plurality of stationary roper bodies rotatably arranged in a fixed position on the base part; at least two clamping arms pivotally mounted to the base part; a plurality of pivoting roller bodies, at least one of said pivoting roller bodies being rotatably arranged on each of the at least two clamping arms; and an adjustment mechanism for adjusting the at least two clamping arms, the adjustment mechanism having a threaded spindle which is operatively connected to the at least two clamping arms and configured to pivot the at least two clamping arms upon axial movement of the threaded spindle and a threaded part configured to radially engage and disengage the threaded spindle while maintaining an axially fixed position relative to the base part, wherein the at least two clamping arms allow a clamping force to be exerted on the work piece, wherein by means of said plurality of stationary roger bodies and said plurality of pivoting roller bodies the work piece can be rotated relative to the holding apparatus when the work piece is in a held state, wherein the threaded spindle is connected to the at least two clamping arms by two intermediate elements, and wherein at least one of the two intermediate elements has two length sections connected to one another by a setting device configured to change a distance between the two length sections.

* * * * *